US006729873B2

(12) United States Patent
Neufield et al.

(10) Patent No.: US 6,729,873 B2
(45) Date of Patent: May 4, 2004

(54) AUTOMATIC FLAME-OUT DETECTOR AND REIGNITION SYSTEM AND METHOD OF IGNITION

(75) Inventors: Hank Neufield, Tulsa, OK (US); Bruce McCorkle, Tulsa, OK (US); Ron Andoe, Broken Arrow, OK (US)

(73) Assignee: W. C. Bradley Company, Columbus, GA (US)

( * ) Notice: Subject to any disclaimer, the term of this patent is extended or adjusted under 35 U.S.C. 154(b) by 0 days.

(21) Appl. No.: 10/176,863

(22) Filed: Jun. 20, 2002

(65) Prior Publication Data

US 2002/0197575 A1 Dec. 26, 2002

Related U.S. Application Data

(60) Provisional application No. 60/299,705, filed on Jun. 20, 2001.

(51) Int. Cl.[7] ..... F23Q 9/08
(52) U.S. Cl. ..... 431/12; 431/42
(58) Field of Search ..... 431/12, 42, 256, 431/258

(56) References Cited

U.S. PATENT DOCUMENTS 4,025,281 A * 5/1977 Lapp ..... 431/5
5,881,681 A * 3/1999 Stuart ..... 122/18.31
5,927,963 A * 7/1999 Wolcott et al. ..... 431/264
6,089,856 A * 7/2000 Wolcott et al. ..... 431/18

* cited by examiner

*Primary Examiner*—Alfred Basichas
(74) *Attorney, Agent, or Firm*—James W. Kayden; Thomas, Kayden, Horstemeyer & Risley, LLP

(57) ABSTRACT

An automatic flame-out detector and reignition system for a fuel burning apparatus comprises at least one spark generator. The spark generator comprises a spark gap and a transformer. The transformer has a primary winding and a secondary winding. The spark gap is connected across the secondary winding of the transformer. A switch is in electrical communication with the primary winding such that when the switch is in a first state, electrical current may flow through the primary winding and when the switch is in a second state, electrical current may not flow through the primary winding. The system comprises at least one flame detector having an output indicating the presence of a flame. A programmable circuit having an input for receiving the output of the flame detector and an output for triggering the spark generator is provided. A method of ignition is also provided.

2 Claims, 6 Drawing Sheets

AUTOMATIC FLAME-OUT DETECTOR AND REIGNITION SYSTEM AND METHOD OF IGNITION

CROSS-REFERENCE TO RELATED APPLICATION

This application claims priority to copending U.S. provisional application entitled, "Automatic Flame-Out Detector and Reignition Device," having ser. No. 60/299,705, filed Jun. 20, 2001, which is entirely incorporated herein by reference.

BACKGROUND OF THE INVENTION

1. Field of the Invention

This invention relates generally to an ignition system for a pilotless burner. More particularly, the present invention relates to an automatic flame-out detector and reignition system and method of ignition.

2. Background

Automatic pilotless ignition systems are well known in the art. A typical ignition system will provide primary ignition and, while fuel is flowing to the burner, monitor the flame. In the event of a flame-out condition, the ignition system will reactivate the ignition source to reignite the flame. While such devices have been in wide use in home appliances, their use in recreational devices has been limited.

Automatic ignition systems for home appliances have historically employed one of two ignition methods. Spark gap igniters have been the most prevalent. Generally, a spark gap igniter provides a spark gap at a point where, during an ignition operation, there will simultaneously be fuel and air. During an ignition sequence, the igniter receives electrical power from a power source and transforms the voltage to a level sufficient to overcome the dielectric strength of the air between the electrodes of the spark gap, thereby resulting in an electrical arc across the gap. Typically, the electrical energy for the arc is stored in a capacitor to provide a spark of sufficient energy without placing an instantaneous, unrealistic demand on the power source.

The other common ignition method employs the use of a hot surface igniter. Generally, a small heater element, placed in a position where fuel and air will be present during an ignition sequence, is heated to a temperature above the flash point of the burner's fuel. As fuel comes into contact with the hot surface, it is ignited. Advantages of this system include a constant ignition source during the ignition operation, unlike a spark gap igniter wherein the spark is of relatively short duration, and less complex circuitry is required to activate the ignition source. The disadvantage of the hot surface igniter is the relatively large amount of electrical power required to heat the hot surface element. For battery operated devices, the spark gap igniter is more practical since it potentially requires less electrical power and thus will provide a system with longer battery life.

Recreational appliances are small, light weight devices intended for camping, hiking, picnics, or similar activities. In a typical recreational appliance, an automatic ignition system would ideally be battery operated, totally self-contained and relatively impervious to the elements, such as wind and rain. A camp stove is an example of a recreational appliance well suited for an automatic ignition system.

Typically, a camp stove provides one or two burners and a valve associated with each burner for adjusting the flow of fuel. Some stoves provide a manual ignition system which uses a piezo crystal to convert mechanical energy supplied by the operator to electrical energy for producing an electrical spark to ignite the fuel.

Since camp stoves are intended for outdoor use, it is not uncommon for the flame to become extinguished due to wind. In this event, the user must recognize the flame-out condition and manually re-light the burner, either with a match or, if the stove is so equipped, by operating the igniter mechanism.

In prior art automatic ignition systems designed for home appliances, the size and weight of the ignition system have not been of great concern. Thus, prior art ignition systems have been drawn to an ignition system per burner, resulting in unnecessarily replicated circuitry. In addition, since these devices tend to operate from household power, efficiency of the ignition system has likewise not been of great concern. In an ignition system for a camp stove, however, size, weight, and battery life are important factors and therefore replicating circuitry is undesirable.

Another limitation of prior art automatic ignition systems has been nuisance ignition cycles. Flame-out detection, as employed in home appliances, has been susceptible to false flame-out indications, particularly under windy conditions. Nuisance ignition cycles result in unnecessary sparking which produces a periodic ticking sound. The outdoor environment where a camp stove is generally used, subjects the stove to a far greater range of environmental factors than those of an indoor appliance and thus, aggravates the problems associated with nuisance sparking. Nuisance sparking in a camp stove not only results in an annoying ticking sound, it also results in reduced battery life.

Thus, a heretofore unaddressed need exists in the industry to address the aforementioned deficiencies and inadequacies.

SUMMARY OF THE INVENTION

Preferred embodiments of the present invention provide an automatic flame-out detector and reignition system and method for ignition. Briefly described, in architecture, one embodiment of the apparatus can be implemented as follows. An automatic flame-out detector and reignition system for a fuel burning apparatus comprises at least one spark generator. The spark generator comprises a spark gap and a transformer. The transformer has a primary winding and a secondary winding. The spark gap is connected across the secondary winding of the transformer. A switch is in electrical communication with the primary winding such that when the switch is in a first state, electrical current may flow through the primary winding and when the switch is in a second state, electrical current may not flow through the primary winding. The system comprises at least one flame detector having an output indicating the presence of a flame. A programmable circuit having an input for receiving the output of the flame detector and an output for triggering the spark generator is provided.

Preferred embodiments of the present invention can also be viewed as providing methods of igniting a cooking apparatus. In this regard, one embodiment of such a method, among others, can be broadly summarized by the following steps: (a) monitoring a fuel valve position to determine the position of a fuel valve having an open position and a closed position; (b) triggering a spark generator upon determining the position of the fuel valve being disposed in the open position; (c) monitoring a flame detector to determine a flameout condition; and (d) repeating steps (a) through (d).

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 3 illustrates a block diagram of an embodiment of an automatic flame-out detector and reignition apparatus of the present invention.

DETAILED DESCRIPTION OF THE PREFERRED EMBODIMENTS

Figure 1:
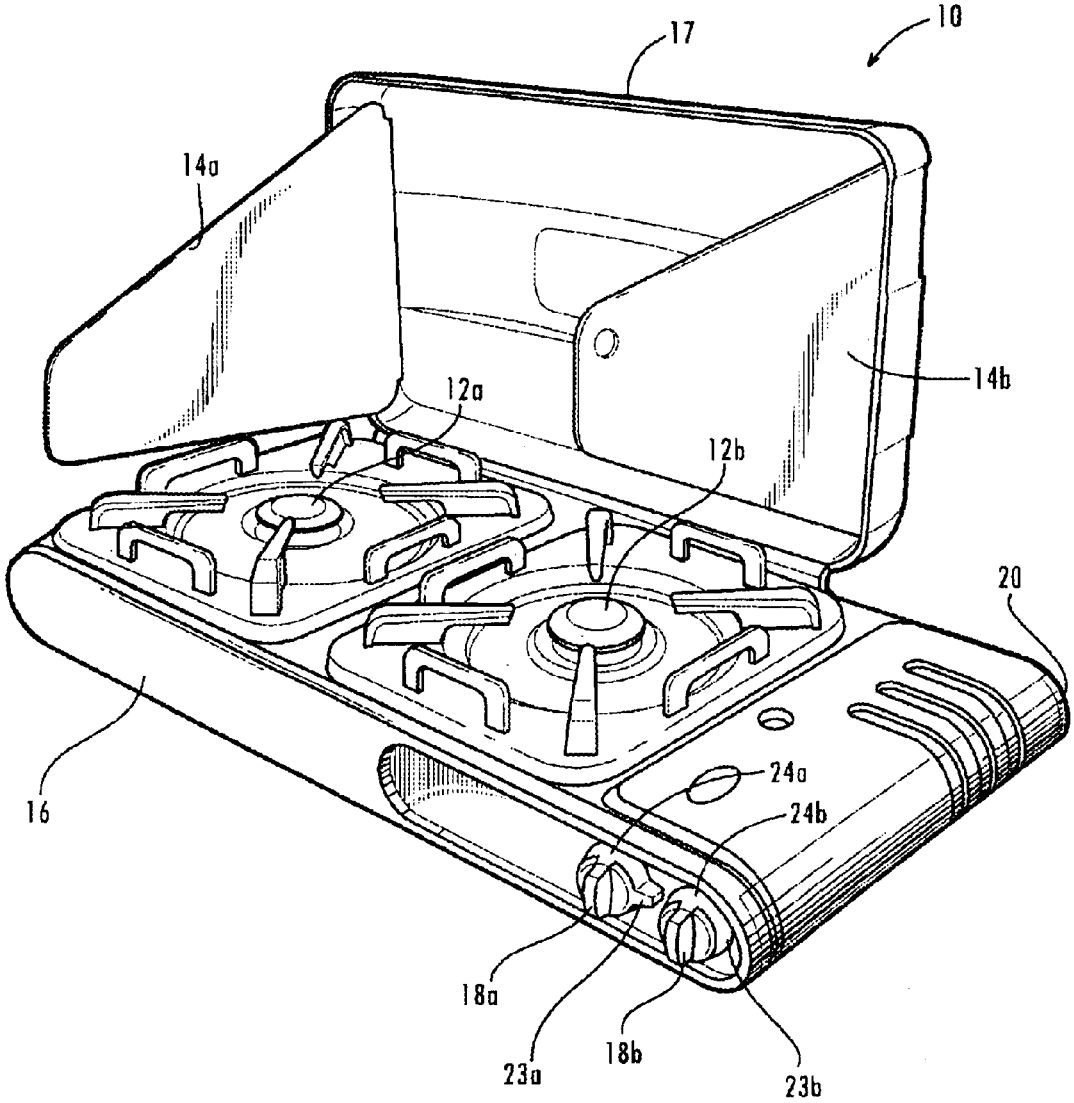
FIG. 1 illustrates a perspective view of an embodiment of a cooking apparatus comprising an embodiment of an automatic flame-out detector and reignition apparatus of the present invention.

FIG. 1 illustrates one preferred embodiment of an automatic flame-out detector and reignition system 22 implemented in a camp stove 10. It should be understood that although the system 22 is illustrated and discussed herein as implemented in a camp stove 10, the system 22 can be implemented in any apparatus in which an ignition system is used to ignite fuel. Preferably, a camp stove 10 comprises burners 12*a* and 12*b* attached to a base 16. A first valve 18*a* and second valve 18*b* control the flow of fuel from the fuel source 20 to burner 12*a* and burner 12*b*, respectively. A cover 17 folds to a vertical position to provide a rear shield for burners 12*a* and 12*b*. Side shields 14*a* and 14*b* protect the burners 12*a* and 12*b* from wind. Automatic flame-out detector and reignition system 22 (FIG. 3) is implemented in the camp stove 10. The fuel source 20 can comprise propane, or any suitable fuel.

Valve 18*a* is provided to control the flow of fuel to burner 12*a*. Preferably, valve 18*a* has a closed position 23*a* wherein no fuel, or minimal fuel, is provided to burner 18*a* and an adjustable open range 24*a* wherein the rate of fuel flow may be controlled by the user. In addition, valve 18*a* includes electrical switch 26*a* (FIG. 3). Preferably switch 26*a* provides an open circuit when valve 118*a* is in its closed position 23*a*. Alternatively, switch 26*a* provides a closed circuit when valve 18*a* is positioned anywhere within its adjustable range 24*a*, thereby providing an indication of fuel flow to burner 12*a*.

Similarly, valve 18*b* preferably has a closed position 23*b* and an open range 24*b*. When valve 18*b* is in a closed position 23*b*, switch 26*b* (FIG. 3) will have open contacts. When valve 18*b* is turned to within an adjustable range 24*b*, switch 26*b* will have closed contacts.

In one embodiment, a microcontroller 38, a programmable electronic circuit which includes a central processing unit and a variety of memory and peripheral functions which directly support the central processing unit such as programmable non-volatile memory, random access memory, input and output devices, and possibly one or more programmable timers, etc., is employed. It will be apparent to those skilled in the art that while the inventive device has been described with reference to a microcontroller, the invention is not so limited. There exist numerous programmable electronic circuits which are capable of carrying out the decision making and control functions of the inventive device. By way of example and not limitation, such devices include microprocessors, PROM controllers, and the like.

Figure 2:
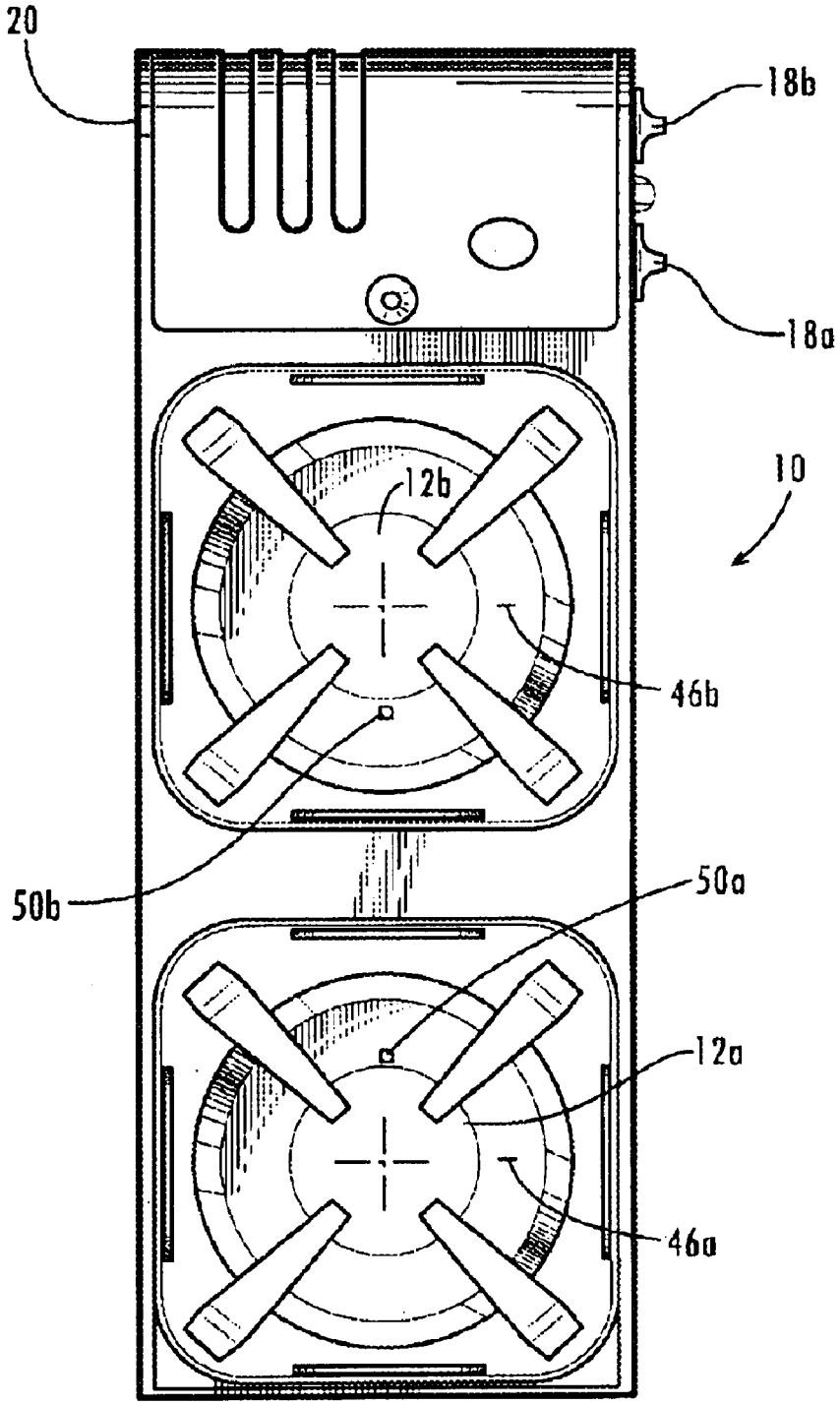
FIG. 2 illustrates a top view of a cooking apparatus illustrated in FIG. 1 comprising an embodiment of an automatic flame-out detector and reignition apparatus of the present invention.
Figure 5:
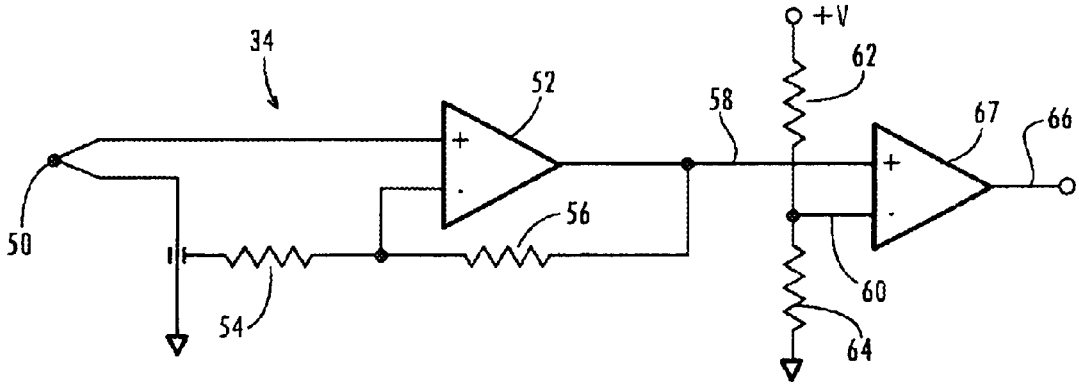
FIG. 5 illustrates an electrical schematic of an embodiment of a flame detector incorporated in the automatic flame-out detector and reignition apparatus illustrated in FIG. 3.

The system 22 further comprises at least one flame detector 34*a*, 34*b*. Turning to FIG. 5, a preferred embodiment of a flame detector 34 is illustrated. It should be noted that flame detector 34 discussed herein is exemplar of flame detector 34*a* and 34*b*. Thermocouple 50 outputs a signal that is amplified by amplifier 52 to produce an amplified temperature signal 58. The gain of amplifier 52 is selected with resistors 54 and 56. The amplified temperature signal 58 is compared to a reference voltage 60, determined by resistors 62 and 64, by comparator 67 to produce a binary output 66 which indicates the presence of a flame in one binary state or the absence of a flame in its other binary state. As shown in FIG. 3, output 66*a* of flame detector 34*a* is connected to digital input 100 of microcontroller 38. Likewise, output 66*b* of flame detector 34*b* is connected to digital input 102 of microcontroller 38. Thermocouples 50*a* and 50*b* are located in a position such that temperature in a desired location, such as for example around the burner, can be monitored. For example, the thermocouples 50*a* and 50*b* can be disposed substantially adjacent the burners 12*a* and 12*b*, respectively (FIG. 2).

Figure 6:
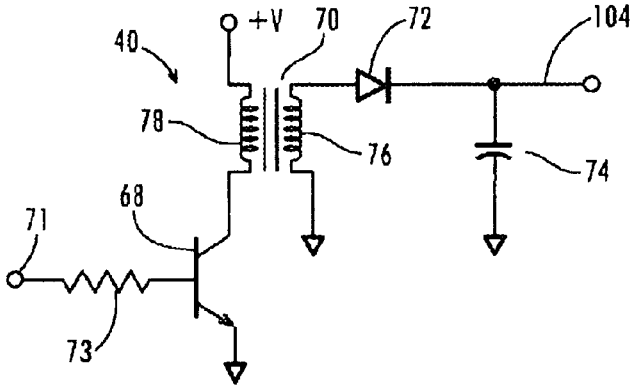
FIG. 6 illustrates an electrical schematic of an embodiment of an inverter incorporated in the automatic flame-out detector and reignition apparatus illustrated in FIG. 3.
Figure 7:
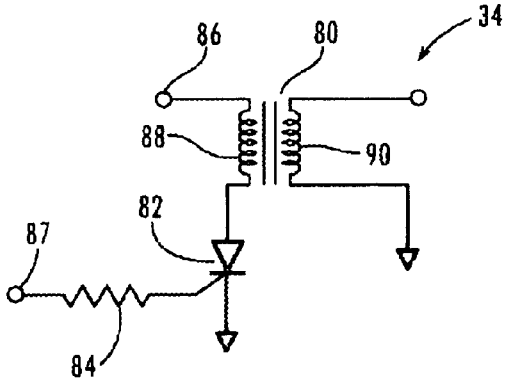

The system 22 further comprises an optional inverter 40. More specifically, and with reference to FIG. 6, a preferred embodiment of the inverter 40 includes transistor 68, transformer 70, diode 72, resistor 73, and capacitor 74. The inverter 40 transforms the low voltage supplied by the battery into a relatively high voltage and stores a charge in capacitor 74 at the higher voltage for subsequent discharge to produce a spark. In operation, microcontroller 38 switches transistor 68 on and off in a cyclic fashion with output 104 (FIG. 3) connected to input 71 to produce an alternating current through the primary winding 78 of transformer 70. Resistor 73 limits the current supplied by output 104 to a desired level. The turns ratio of transformer 70 is such that a substantially higher voltage is produced across secondary winding 76. Diode 72 rectifies the output of secondary 76 and capacitor 74 is charged to the rectified voltage so produced over the course of several cycles of output 104.

Figure 7:
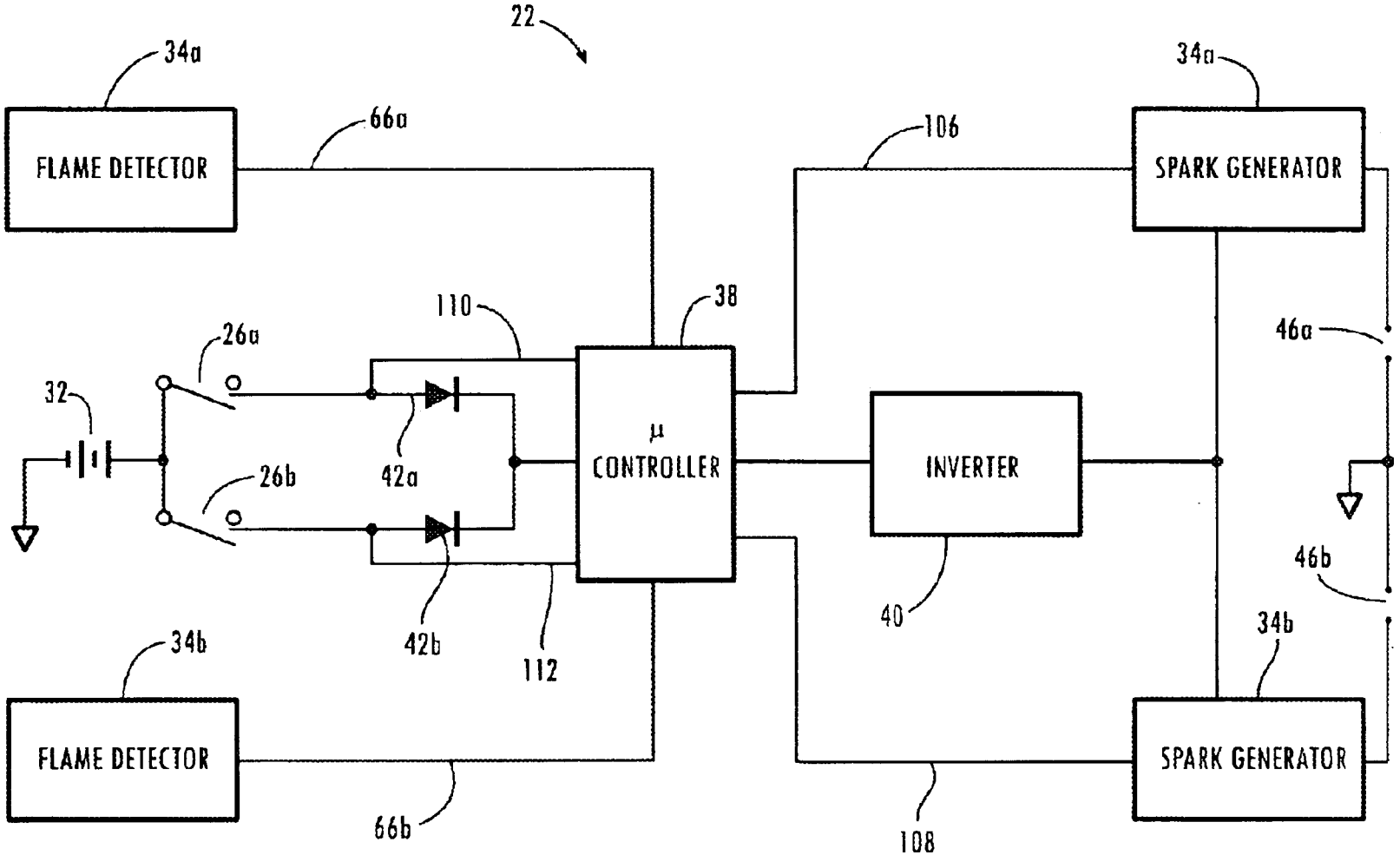
FIG. 7 illustrates an electrical schematic of an embodiment of a spark generator incorporated in the automatic flame-out detector and reignition apparatus illustrated in FIG. 3.

The system 22 further comprises at least one spark generator 36*a* and 36*b*. More specifically, and with reference to FIG. 7, a preferred embodiment of a spark generator 36 is shown. It should be noted that spark generator 36 discussed herein is exemplar of spark generator 36*a* and 36*b*. The spark generator 36 includes transformer 80, silicon controlled rectifier (SCR) 82, and resistor 84. Spark generator 36 receives high voltage from the inverter 40 at input 86. Upon activation of the SCR 82 through trigger 87, current flows through the primary 88 of transformer 80 until capacitor 74 of inverter 40 is discharged. The flow of current through primary 88 induces a voltage across secondary 90. The turns ratio of transformer 80 is such that the voltage produced across secondary 90 is sufficient to create an electrical arc across spark gap 46 (FIG. 3). The spark gaps 46*a* and 46*b* are positioned such that the electrical arc generated between the spark gaps 46*a* and 46*b* ignite fuel. As such, it is desirable that the spark gaps 46*a* and 46*b* are positioned substantially adjacent the burners 12*a* and 12*b*, respectively. Continuing to refer to FIG. 3, microcontroller 38 sets output 106 to a logical high to trigger spark generator 36*a* or output 108 to a logical high to trigger spark generator 36*b*.

It will be apparent to those skilled in the art that, while there are advantages to including inverter 40, its presence is not absolutely necessary and the invention is not so limited. Advantages realized by storing the energy for the spark at a higher voltage in capacitor 74 include a substantial reduction in the value of capacitor 74 to store the energy required for a suitable spark, a reduction in the electrical current passing through secondary 90 and SCR 82, and a reduction in the turns ratio of transformer 80. However, the spark voltage could be produced directly from battery voltage through any conventional method of stepping-up voltage.

Referring once again to FIG. 3, when the user turns on a valve 18*a* or 18*b*, the appropriate switch 26*a* or 26*b* is closed. Upon closing of the switch, the igniter control circuit receives power from the battery either through diode 42*a* or 42*b*. The microcontroller 38 senses the opened valve through input 110 or input 112. Diode 42*a* ensures that input 110 will be read a binary low unless switch 26*a* is closed and diode 42*b* ensures that input 112 will be read as a binary low unless switch 26*b* is closed.

Figure 4A:
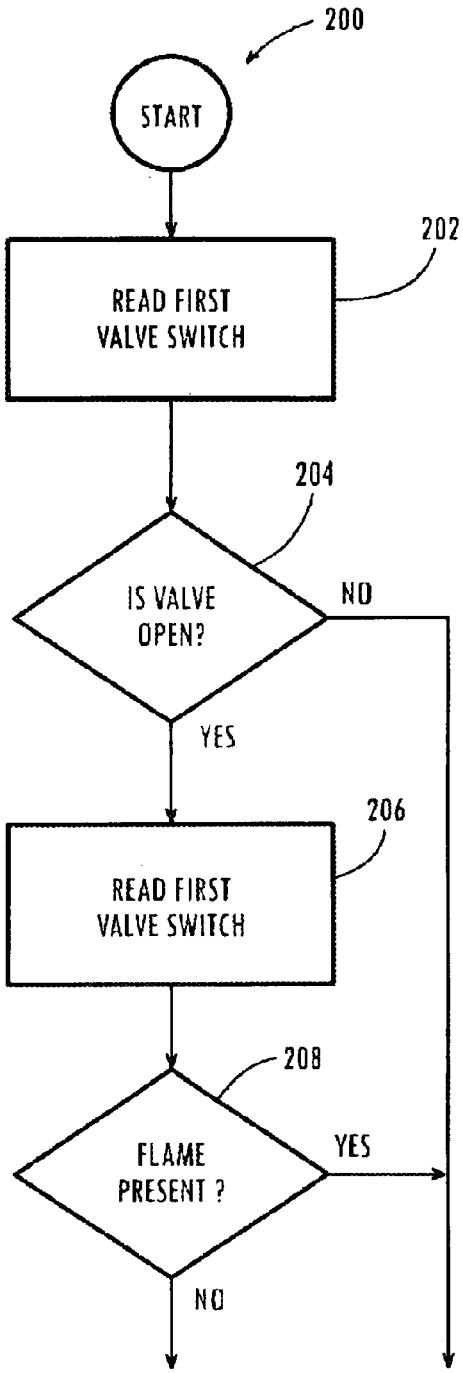
FIG. 4A illustrates a flow chart for a computer program as incorporated in an embodiment of an automatic flame-out detector and reignition apparatus illustrated in FIG. 3.
Figure 4B:
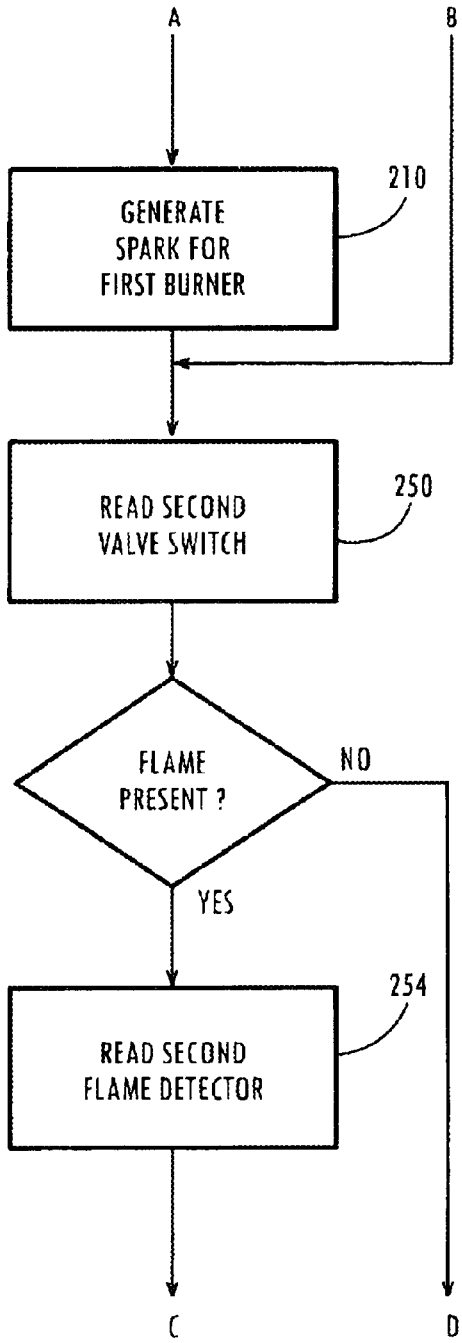
FIG. 4B illustrates a flow chart for a computer program as incorporated in an embodiment of an automatic flame-out detector and reignition apparatus illustrated in FIG. 3.
Figure 4C:
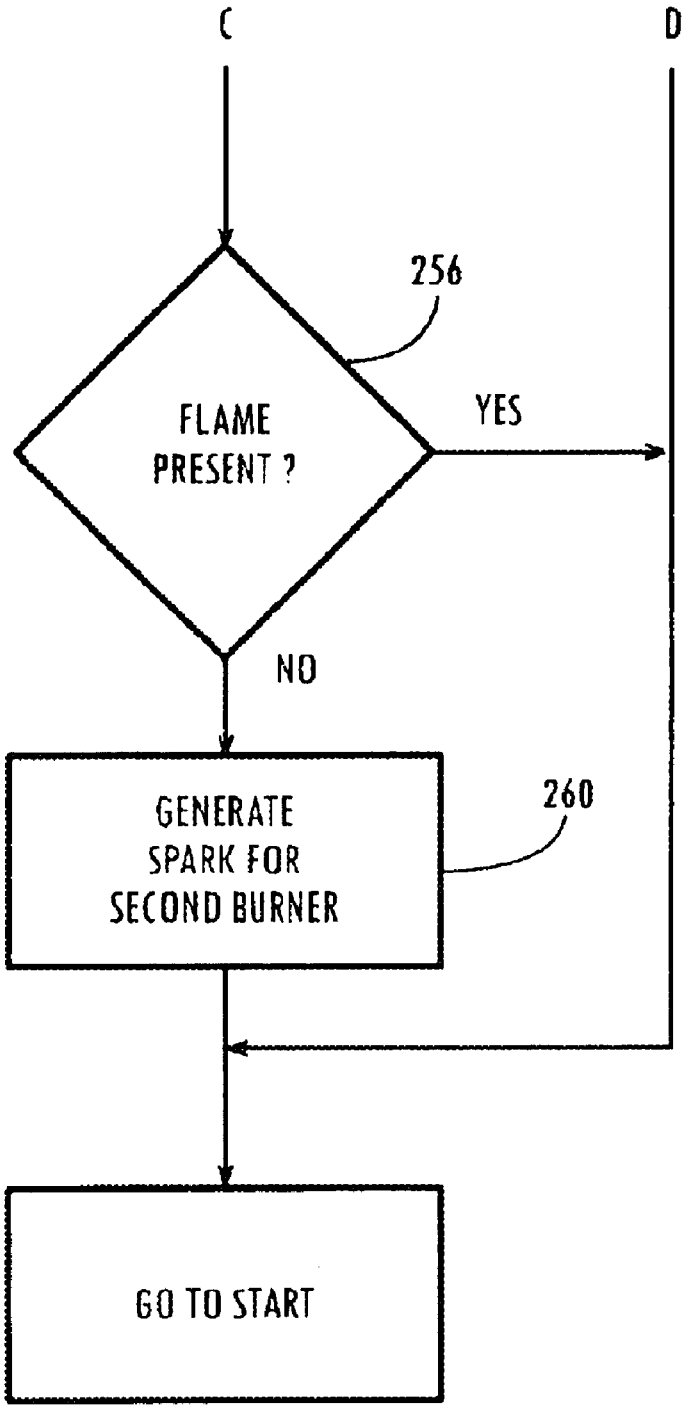
FIG. 4C illustrates a flow chart for a computer program as incorporated in an embodiment of an automatic flame-out detector and reignition apparatus illustrated in FIG. 3.

FIGS. 4A–4C illustrates a preferred method of ignition. More specifically, a flow chart for a computer program as incorporated in the preferred embodiment of the system 22 is illustrated. In operation, when the user turns on one or both valves 18*a* or 118*b* the system 22 receives electrical power as a result of the closure of switch 26*a* or 26*b*. Upon receiving electrical power, microcontroller 38 begins executing the program 200 at 202 by reading the input 110 which receives the signal from switch 26*a* indicating the status of valve 18*a*. At 204, if valve 18*a* is closed, the program branches to 250 to provide control for the other burner 12*b*. If, on the other hand, valve 18*a* is open, the flame detector 34*a* is read at 206. At 208, if a flame is present, the program branches to 250 to provide control from the other burner 12*b*. If a flame is not present, a spark is generated at 210 for burner 12*a*.

At 250, the above process repeats for burner 12*b*. First, input 112 is read indicating the position of valve 18*b*. At 252, if valve 18*b* is closed, the program branches back to the beginning 202 and the process repeats. If, on the other hand, valve 18*b* is open, the flame detector 34*b* is read at 254 and, at 256 if a flame is present, the program branches to 202. If a flame is not present, a spark is generated at 260 for burner 12*b*. The program then returns to 202 to repeat the process.

Referring back to FIG. 3, to generate a spark, the microcontroller 38 begins by cycling output 104 on and off for a predetermined period of time until capacitor 74 becomes charged to a sparking voltage. Thereafter, to ignite burner 12*a*, the microcontroller 38 momentarily sets output 106 high, thereby triggering the spark generator 36*a*. The spark generator 36*a* triggers an arc of electricity across spark gap 46*a* sufficient to ignite fuel being fed to the burner 12*a*. Alternatively, to ignite burner 12*b*, microcontroller 38 momentarily sets output 108 high, thereby triggering spark generator 36*b*. The spark generator 36*b* triggers an arc of electricity across spark gap 46*b* sufficient to ignite fuel being fed to the burner 12*b*.

Although the inventive apparatus is shown herein and described as incorporated in a two burner camp stove, it is equally adaptable for use in camp stove with a single burner, in camp stoves with more than two burners, and in other appliances. As will be understood by those skilled in the art, the micrcontroller and inverter may be used with any number of flame detectors and spark generators to provide ignition for any number of burners.

As will be understood by those skilled in the art, although the above preferred embodiment of the inventive apparatus has been shown as incorporated in a camp stove, it is equally suitable for use in outdoor barbecue grills, in recreational vehicle stoves, and other appliances.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A method for automatically igniting a fuel burning apparatus comprising:

(a) monitoring a fuel value position to determine said position of a fuel valve having an open position and a closed position;

(b) triggering a spark generator upon determining the position of said fuel valve being disposed in said open position;

(c) monitoring a flame detector to determine a flame-out condition; and (d) repeating (a) through (d).

2. The method of claim 1, wherein said triggering a spark generator comprises:

generating an electrical arc across a spark gap.

* * * * *